US012196477B2

(12) United States Patent
Chun et al.

(10) Patent No.: US 12,196,477 B2
(45) Date of Patent: Jan. 14, 2025

(54) REFRIGERATOR INCLUDING MODULE HAVING PLURALITY OF STORAGE CHAMBERS

(71) Applicant: LG ELECTRONICS INC., Seoul (KR)

(72) Inventors: Chanho Chun, Seoul (KR); Junlae Park, Seoul (KR); Hyokeun Park, Seoul (KR); Taehee Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 218 days.

(21) Appl. No.: 17/779,451

(22) PCT Filed: Sep. 23, 2020

(86) PCT No.: PCT/KR2020/012838
§ 371 (c)(1),
(2) Date: May 24, 2022

(87) PCT Pub. No.: WO2021/107368
PCT Pub. Date: Jun. 3, 2021

(65) Prior Publication Data

US 2022/0404088 A1 Dec. 22, 2022

(30) Foreign Application Priority Data

Nov. 28, 2019 (KR) ..... 10-2019-0155136

(51) Int. Cl.
*F25D 19/02* (2006.01)
*F25D 17/00* (2006.01)
(Continued)

(52) U.S. Cl.
CPC ..... *F25D 19/02* (2013.01); *F25D 17/00* (2013.01); *F25D 19/04* (2013.01); *F25D 21/14* (2013.01); *F25D 29/00* (2013.01); *F25D 2400/36* (2013.01)

(58) Field of Classification Search
CPC ..... F25D 13/02; F25D 23/00; F25D 23/003; F25D 19/02; F25D 17/00; F25D 19/04;
(Continued)

(56) References Cited

U.S. PATENT DOCUMENTS 3,089,313 A * 5/1963 Fix ..... F25D 13/02 296/181.6
5,921,095 A 7/1999 Lee et al.
(Continued)

FOREIGN PATENT DOCUMENTS

DE 19957530 A1 * 5/2001 ..... A47F 10/00
EP 2950283 A1 * 12/2015 ..... G06Q 10/0836
(Continued)

OTHER PUBLICATIONS

English Language translation of DE 19957530 to Eberhard. (Year: 2001).*
(Continued)

*Primary Examiner* — Cassey D Bauer
(74) *Attorney, Agent, or Firm* — Bryan Cave Leighton Paisner LLP

(57) ABSTRACT

The present disclosure relates to a refrigerator, and more particularly, to a refrigerator including one or more modules having a plurality of rooms. An embodiment of the present disclosure may provide a refrigerator including a plurality of refrigerator modules, wherein the refrigerator modules include: a cabinet forming an outer shape and having a plurality of storage chambers therein; doors provided in the cabinet and provided for each storage chamber; a radiant cooling plate which forms the rear wall of the storage chambers, and is provided to block the communication of air between the inner portions of the storage chambers and cool the inner portions of the storage chambers through radiant cooling; a refrigerant pipe flow path located at the rear side of the radiant cooling plate to exchange heat with the radiant cooling plate; and a machine room which discharges the refrigerant to the refrigerant pipe flow path and sucks the refrigerant having exchanged heat with the radiant cooling plate.

20 Claims, 13 Drawing Sheets

(51) Int. Cl.

| | |
|---|---|
| ***F25D 19/04*** | (2006.01) |
| ***F25D 21/14*** | (2006.01) |
| ***F25D 29/00*** | (2006.01) |

(58) Field of Classification Search
CPC ..... F25D 21/14; F25D 29/00; F25D 2400/36; A47G 2029/147
See application file for complete search history.

(56) References Cited

U.S. PATENT DOCUMENTS

| | | | |
|---|---|---|---|
| 2015/0241108 | A1 | 8/2015 | Maldonado |
| 2017/0215620 | A1 | 8/2017 | Dade et al. |

FOREIGN PATENT DOCUMENTS

| | | | |
|---|---|---|---|
| JP | H09-329382 | A | 12/1997 |
| JP | 2004101028 | A | 4/2004 |
| JP | 2010043750 | A | 2/2010 |
| KR | 20160023459 | A | 3/2016 |
| KR | 20180126859 | A | 11/2018 |

OTHER PUBLICATIONS

English language translation of JP2010043750 to Masahiro. (Year: 2010).*

* cited by examiner

REFRIGERATOR INCLUDING MODULE HAVING PLURALITY OF STORAGE CHAMBERS

CROSS-REFERENCE TO RELATED APPLICATIONS

This application is a National Stage filing under 35 U.S.C. 371 of International Application No. PCT/KR2020/012838, with an international filing date of Sep. 23, 2020, which claims the benefit of KR Patent Application No. 10-2019-0155136, filed on Nov. 28, 2019, all of which are incorporated by reference in their entirety herein.

TECHNICAL FIELD

The present disclosure relates to a refrigerator, and relates to a refrigerator including one module or a plurality of modules having a plurality of rooms (storage chambers).

BACKGROUND

In general, a refrigerator is an apparatus for refrigerating or freezing a stored product and is used in homes and businesses such as restaurants. A refrigerator is often used by family members or business members.

However, it may be very inconvenient for multiple users to share one refrigerator in a space used by the multiple users, for example, in a space (hereinafter, referred to as a "shared space") such as an office, a hospital, a shared house, a dormitory, or a school. This is because other users may use a stored product of a specific user, or the stored product of the specific user may be left unattended for a long time, causing inconvenience to other users.

In order to solve such problem, installing several small refrigerators in the shared space may be considered. However, even though it is a small refrigerator, it is one refrigerator by itself, and thus effective space utilization is not realized. In addition, there may be a problem of not being able to prevent an unauthorized user from using a specific refrigerator.

Therefore, it is desirable to provide a shared refrigerator that may be installed in the shared space providing for effective space utilization and have rooms for the respective users.

Recently, online ordering and refrigerated delivery of fresh food such as meat, vegetables, and lunch boxes as well as food such as milk are in the spotlight. However, it may be difficult to maintain a refrigerated state of the food until the food is delivered to the consumer after completion of the delivery. This is because the consumer may not be able to physically receive the food on delivery. Accordingly, excessive packaging using thermal insulation packaging for the fresh food may be required, and the excessive packaging may cause environmental pollution.

Therefore, it may be necessary to find a way to temporarily store the delivered refrigerated food or directly deliver the refrigerated food to a refrigerator of the user.

DISCLOSURE

Technical Problem

The present disclosure is to provide a new type of shared refrigerator that may be installed in a shared space.

The present disclosure is to provide a refrigerator having a refrigerator module in which a plurality of rooms are opened and closed by individual doors.

The present disclosure is to provide a refrigerator capable of easily expanding the number of rooms by making it easy to vertically or horizontally expand a refrigerator module according to one embodiment of the present disclosure.

The present disclosure is to provide a refrigerator that may easily form a refrigerator module via one cold air flow path structure and one machine room according to one embodiment of the present disclosure.

The present disclosure is to provide a refrigerator capable of increasing usage satisfaction and independently cooling each room by excluding sharing of cold air between a plurality of rooms according to one embodiment of the present disclosure.

The present disclosure is to provide a refrigerator capable of temporarily storing fresh food after refrigerated delivery or directly delivering the fresh food to a refrigerator of a user according to one embodiment of the present disclosure.

Technical Solutions

In order to implement the above purposes, according to one embodiment of the present disclosure, provided is a refrigerator including a plurality of refrigerator modules, wherein each refrigerator module includes a cabinet forming an appearance of the refrigerator module and having a plurality of storage chambers therein, each door disposed in the cabinet and disposed for each storage chamber, each radiational cooling plate for forming a rear wall of each storage chamber, wherein the radiational cooling plate is disposed to block air communication between an interior of the storage chamber and an interior of another storage chamber, wherein the radiational cooling plate cools the interior of the storage chamber through radiational cooling, a refrigerant pipe flow path located in the rear of the radiational cooling plate to exchange heat with the radiational cooling plate, and a machine room for discharging a refrigerant to the refrigerant pipe flow path and sucking the refrigerant that has exchanged heat with the radiational cooling plate.

It is preferable that the plurality of storage chambers are arranged in a vertical direction, and the machine room is disposed beneath the refrigerator module.

It is preferable that the plurality of refrigerator modules are arranged to be in close contact with each other in a horizontal direction such that the number of the storage chambers increases in the horizontal direction.

It is preferable that each refrigerator module includes each machine room, and the refrigerator includes a base cover for covering the plurality of machine rooms from the front.

It is preferable that the refrigerator further includes a decor for covering a gap in the horizontal direction between the refrigerator modules from the rear of the cabinet.

It is preferable that the door has a user interface for authenticating a user.

It is preferable that the user interface includes an NFC communication module.

It is preferable that the cabinet is integrally formed to integrally accommodate the plurality of storage chambers therein.

It is preferable that the cabinet includes a plurality of cabinets separately formed to respectively accommodate the plurality of storage chambers therein and coupled to each other.

It is preferable that each cabinet includes a coupling portion movable between an interior of the cabinet and an exterior of the cabinet by pivoting, and adjacent cabinets are coupled to each other by mating of coupling portions thereof.

It is preferable that each coupling portion includes a protrusion and an accommodating portion, and a protrusion of one coupling portion is inserted into an accommodating portion of another coupling portion.

It is preferable that each radiational cooling plate is disposed on the rear wall of each storage chamber, and a radiational cooling plate of one storage chamber is separately formed from a radiational cooling plate of another storage chamber.

It is preferable that the refrigerant pipe flow path is disposed to be in close contact with each of the plurality of radiational cooling plates.

It is preferable that the radiational cooling plate and the refrigerant pipe flow path are integrally formed.

It is preferable that each insertion hole is defined in each of a top face and a bottom face of the cabinet such that the refrigerant pipe flow path is inserted into and extends through the cabinet.

It is preferable that the radiational cooling plates are integrally formed to be a single radiational cooling plate, so that the single radiational cooling plate forms the rear walls of the plurality of storage chambers.

It is preferable that the radiational cooling plate and the refrigerant pipe flow path are integrally formed.

It is preferable that each insertion hole is defined in each of a top face and a bottom face of the cabinet such that the single radiational cooling plate and a refrigerant pipe flow path are inserted into and extend through the cabinet.

It is preferable that each opening is defined in each of a top face and a bottom face of the cabinet such that a defrosting water line extends through the cabinet.

It is preferable that the defrosting water line vertically extends through the plurality of storage chambers and then extends to a bottom face of an uppermost storage chamber.

In order to implement the above purposes, according to another embodiment of the present disclosure, provided is a refrigerator including a plurality of refrigerator modules, wherein each refrigerator module includes a cabinet forming an appearance of the refrigerator module and having a plurality of storage chambers therein, each door disposed in the cabinet and disposed for each storage chamber, each radiational cooling plate for forming a rear wall of each storage chamber, wherein the radiational cooling plate is disposed to block air communication between an interior of the storage chamber and an interior of another storage chamber, wherein the radiational cooling plate cools the interior of the storage chamber through radiational cooling, a cold air circulating flow path located in the rear of the radiational cooling plate to supply cold air for heat exchange with the radiational cooling plate, and a machine room for discharging cold air to the cold air circulating flow path and sucking cold air that has exchanged heat with the radiational cooling plate.

It is preferable that the plurality of storage chambers are arranged in a vertical direction, and the machine room is disposed beneath the refrigerator module.

It is preferable that the plurality of refrigerator modules are arranged to be in close contact with each other in a horizontal direction such that the number of the storage chambers increases in the horizontal direction.

It is preferable that each refrigerator module includes each machine room, and the refrigerator includes a base cover for covering the plurality of machine rooms from the front.

It is preferable that the refrigerator further includes a decor for covering a gap in the horizontal direction between the refrigerator modules from the rear of the cabinet.

It is preferable that the door has a user interface for authenticating a user.

It is preferable that the user interface includes an NFC communication module.

It is preferable that the cabinet is integrally formed to integrally accommodate the plurality of storage chambers therein.

It is preferable that the cabinet includes a plurality of cabinets separately formed to respectively accommodate the plurality of storage chambers therein and coupled to each other.

It is preferable that each cabinet includes a coupling portion movable between an interior of the cabinet and an exterior of the cabinet by pivoting, and adjacent cabinets are coupled to each other by mating of coupling portions thereof.

It is preferable that each coupling portion includes a protrusion and an accommodating portion, and a protrusion of one coupling portion is inserted into an accommodating portion of another coupling portion.

It is preferable that each radiational cooling plate is disposed on the rear wall of each storage chamber, and a radiational cooling plate of one storage chamber is separately formed from a radiational cooling plate of another storage chamber.

It is preferable that the cold air circulating flow path is integrally defined to cool all of the plurality of radiational cooling plates.

It is preferable that each insertion hole is defined in each of a top face and a bottom face of the cabinet such that the cold air circulating flow path is inserted into and extends through the cabinet.

It is preferable that the radiational cooling plates are integrally formed to be a single radiational cooling plate, so that the single radiational cooling plate forms the rear walls of the plurality of storage chambers.

It is preferable that the cold air circulating flow path is integrally defined to cool the single radiational cooling plate.

It is preferable that each insertion hole is defined in each of a top face and a bottom face of the cabinet such that the single radiational cooling plate and the cold air circulating flow path are inserted into and extend through the cabinet.

It is preferable that each opening is defined in each of a top face and a bottom face of the cabinet such that a defrosting water line extends through the cabinet.

It is preferable that the defrosting water line vertically extends through the plurality of storage chambers and then extends to a bottom face of an uppermost storage chamber.

It is preferable that power and control lines of one refrigerator module and an adjacent refrigerator module are connected to each other.

In one example, in the above-described embodiments, the cold air circulating flow path and the refrigerant pipe flow path may be referred to as cooling apparatuses that cool the radiational cooling plate outside the storage chamber.

That is, the radiational cooling plate may be exposed to the interior of the storage chamber and may be sealed from the exterior of the storage chamber. Therefore, entrance and exit of cold air between one storage chamber and an adjacent storage chamber is blocked. In addition, the cooling apparatus may be referred to as a component that directly cools the radiational cooling plate from the rear of the radiational cooling plate, that is, outside the storage chamber. As a cooling method, one of radiational cooling plate cooling by cold air and radiational cooling plate cooling by a refrigerant may be applied.

Advantageous Effects

According to one embodiment of the present disclosure, the refrigerator having the refrigerator module in which the plurality of rooms are opened and closed by the individual doors may be provided.

According to one embodiment of the present disclosure, the refrigerator capable of easily expanding the number of rooms by making it easy to vertically or horizontally expand the refrigerator module may be provided.

According to one embodiment of the present disclosure, the refrigerator that may easily form the refrigerator module via one cold air flow path structure and one machine room may be provided.

According to one embodiment of the present disclosure, the refrigerator capable of increasing the usage satisfaction and independently cooling each room by excluding the sharing of the cold air between the plurality of rooms may be provided.

According to one embodiment of the present disclosure, the refrigerator capable of temporarily storing the fresh food after the refrigerated delivery or directly delivering the fresh food to the refrigerator of the user may be provided.

BEST MODE

Hereinafter, a refrigerator according to an embodiment of the present disclosure will be described in detail with reference to the accompanying drawings.

Figure 1:
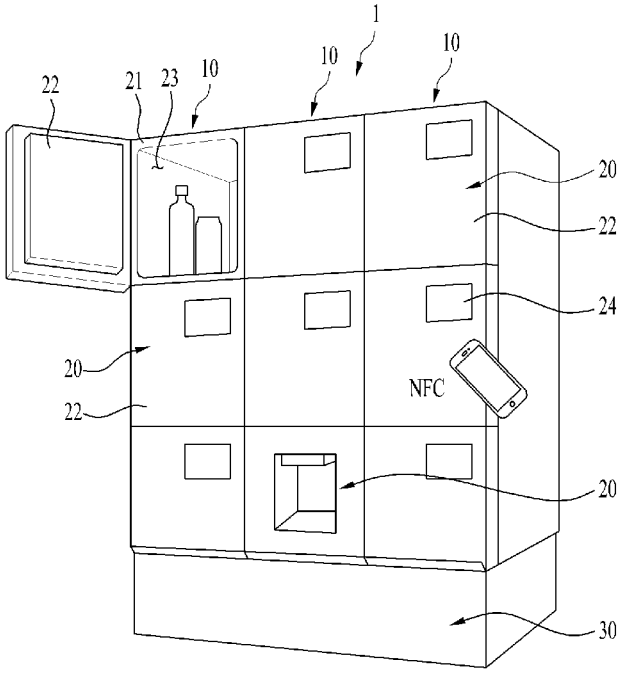
FIG. 1 shows a refrigerator, in particular, a shared refrigerator that may be applied to one embodiment of the present disclosure.

FIG. 1 shows a concept of a refrigerator according to an embodiment of the present disclosure. Hereinafter, the refrigerator according to the present embodiment will be referred to as a shared refrigerator in order to distinguish from a regular refrigerator.

As shown, the shared refrigerator 1 may include a plurality of rooms (storage chambers) 23 and a machine room 30. Each of the plurality of rooms may have a door 22 for opening and closing the room.

In this regard, one room and one door may be referred to as a cooling unit 20 for convenience. In another example, the cooling unit may include a cabinet 21 that forms an outer appearance and defines the storage chamber therein. The cabinet may be separately formed for each single cooling unit, or the cabinet may be formed as a whole module including a plurality of cooling units.

A single cooling unit 20 may perform a function of a refrigerator for refrigerating a stored product or a function of a freezer for freezing the stored product. The single cooling unit may be specialized as a refrigerator or may be specialized as a freezer. In another example, switching between the refrigerator and the freezer may be performed by setting the storage temperature.

The single cooling unit may be assigned to a specific user. That is, it is possible to assign a cooling unit to each user. In this case, a specific user is able to only use a specific cooling unit.

A user interface 24 may be disposed on a front face of the door 22. The user interface may be disposed for user authentication. When the user inputs personal information and receives approval, the door 22 may be opened. That is, it is possible to prevent an unauthorized user from opening the door. In this case, although not shown, a door locking device may be disposed.

In one example, the user interface 24 may be equipped for short-range wireless communication with a portable terminal. For example, the user interface 24 may have a near-field communication (NFC) communication module. Accordingly, the user may be authenticated as the specific user by tagging a portable terminal thereof on the user interface 24.

The shared refrigerator 1 may be used for commercial purposes. That is, a provider of the entire shared refrigerator 1 and the user who leases a cooling unit 20 may be distinguished. In addition, an application for remotely managing the shared refrigerator 1 may be installed in portable terminals of the provider and the user, respectively.

Therefore, the provider and the user may use various remote services such as payment, use approval, and remote control of the refrigerator using the portable terminals.

As an example, the user may remotely open a door of the cooling unit assigned to the user. That is, the locking device of the door may be remotely released. A person who delivers fresh food may directly put the fresh food into the user's cooling unit. Therefore, freshness of the fresh food may be maintained and excessive packing may be prevented in advance.

In one example, the person who delivers the fresh food may also get permission to use the user's cooling unit in advance. As an example, a password for opening the door may be sent to the delivery person. While the user orders the fresh food, the user may send location information of the shared refrigerator and the cooling unit thereof, the password, and the like to the delivery person as delivery information. In another example, the delivery person may remotely request the user to unlock the door.

For example, the shared refrigerator may be installed at an entrance lobby of a dormitory. When the fresh food is delivered, a person who placed an order does not need to directly receive the fresh food. That is, the delivery person does not need to directly deliver the fresh food to the person who placed the order. This is because the delivery person is able to put the fresh food directly into the cooling unit of the person who placed the order.

Information such as the number of times of door openings or an opening time of the door may be stored through an application of a portable terminal of the person who placed the order. In addition, it is also possible to remotely monitor and control a temperature of the storage chamber.

In addition, the cooling unit may be equipped with a camera module for photographing an interior of the storage chamber. When the camera module photographs the interior of the storage chamber, the stored product inside the storage chamber may be identified. For example, the user (the person who placed the order) may remotely identify the stored product that has been delivered through the photograph displayed at the portable terminal thereof.

Therefore, according to an embodiment of the present disclosure, the shared refrigerator may perform a function of storing an object as well as a function of storing a delivered product.

In one example, one of the cooling units may be provided as a unit that may be shared without being assigned to a user. For example, an ice maker unit for supplying ice or a water purifier unit for supplying purified water may be disposed in the shared refrigerator. Such an ice maker unit or a water purifier unit may not have a door unlike other cooling units.

For example, FIG. 1 shows the shared refrigerator 1 in which the cooling units are arranged in 3 horizontal rows and 3 vertical columns, and shows an example in which the water purifier unit is disposed in the third row and second column. In addition, an example in which the machine room 30 for operating all of the cooling units and disposed at a bottom of the shared refrigerator 1 is shown.

As shown, the shared refrigerator may include a refrigerator module. The refrigerator module may include a plurality of cooling units. When the shared refrigerator is composed of cooling units arranged in 3 rows and 3 columns, the shared refrigerator may be composed of three refrigerator modules arranged in a horizontal direction or three refrigerator modules arranged in a vertical direction.

As an example, three refrigerator modules 10 arranged in the vertical direction may include a left refrigerator module composed of upper, middle, and lower cooling units on a left side of the shared refrigerator, an intermediate refrigerator module composed of upper, middle, and lower cooling units in the middle of the shared refrigerator, and a right refrigerator module composed of upper, middle, and lower cooling units on a right side of the shared refrigerator. In another example, the number of cooling units in one refrigerator module may be 2 or equal to or greater than 4.

When one refrigerator module 10 has a plurality of cooling units 20 in the vertical direction, the machine room 30 of the shared refrigerator may be preferably located at the bottom. Therefore, the lowest cooling unit of the refrigerator module in the shared refrigerator is positioned on top of the machine room to promote convenience of use. In addition, as will be described later, it may further facilitate definition of a cold air flow path between the machine room and each refrigerator module.

In one example, when the refrigerator module has a plurality of cooling units 20 in the horizontal direction, the machine room of the shared refrigerator may be preferably located on a side of the shared refrigerator 1.

In this regard, one machine room may be disposed to cover one refrigerator module or may be disposed to cover the plurality of refrigerator modules. Accordingly, as the number of refrigerator modules increases, a size of one machine room may also increase. In another example, as the size of one machine room increases, the number of components such as an evaporator disposed in the machine room may also increase.

The cooling units 20 may be manufactured separately from each other, and the shared refrigerator 1 may be formed by stacking the cooling units vertically or making the cooling units to be in close contact with each other.

The plurality of cooling units 20, for example, three cooling units may be integrally formed through one cabinet to form the refrigerator module 10, and one cooling unit may be stacked on top of or beneath the refrigerator module 10. In another example, one refrigerator module 10 may be composed of four or more cooling units 20. In addition, one machine room may be disposed for one refrigerator module 10. Accordingly, when three refrigerator modules 10 are disposed, three machine rooms are disposed to form one shared refrigerator as a whole. In one example, a vertical dimension, a width in the horizontal direction, and the number of units of the shared refrigerator 1 may be extended.

The plurality of cooling units 20, the plurality of refrigerator modules 10, and the machine room 30 may be stacked in the vertical direction and/or may be arranged in the horizontal direction to form one shared refrigerator. Therefore, it may be difficult to secure an aesthetic design due to a connecting portion between one cooling unit and another cooling unit, between one refrigerator module and another refrigerator module, between one machine room and another machine room, and between the machine room and the refrigerator module.

Figure 2:
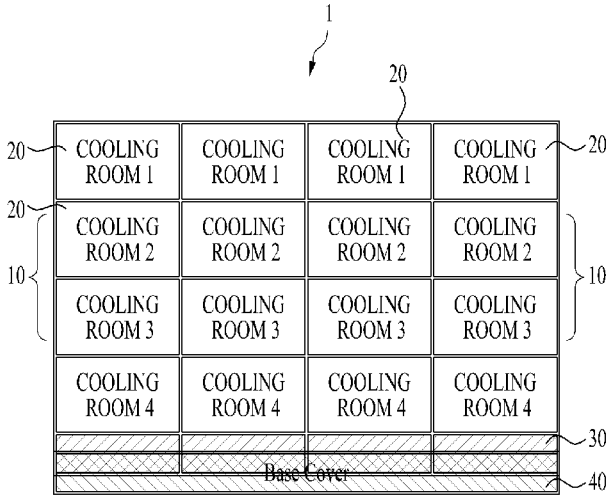
FIG. 2 schematically shows a front face of a shared refrigerator that may be applied to one embodiment of the present disclosure.
Figure 3:
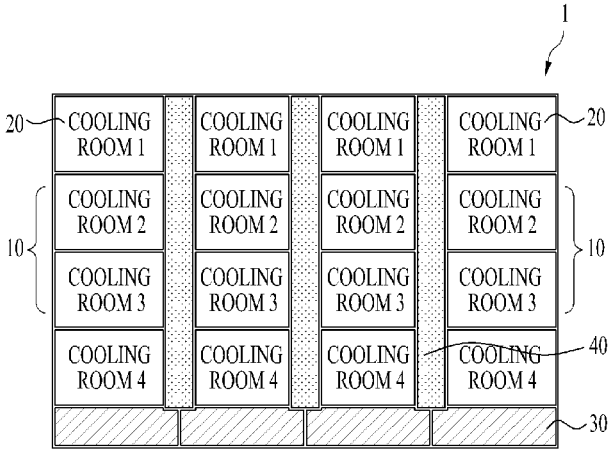
FIG. 3 schematically shows a rear face of a shared refrigerator that may be applied to one embodiment of the present disclosure.

FIG. 2 is a simplified view of a front face of a shared refrigerator, and FIG. 3 is a simplified view of a rear face of a shared refrigerator. As an example, it is shown that three cooling units arranged in the vertical direction form one refrigerator module, and one more cooling unit is stacked on top of the refrigerator module. In general, it is shown that the storage chamber is formed in 4 rows and 4 columns.

As described above, one shared refrigerator is formed by coupling a plurality of sub-elements (the cooling units, the refrigerator modules, and the machine rooms) to each other. Therefore, it may be important to ensure integrity of the appearance.

To this end, a base cover 40 for covering a front face of the bottom of the shared refrigerator 1 may be disposed. The base cover 40 may be attached to front faces of the machine rooms. That is, the base cover 40 may be provided separately from the machine room and may be coupled to the machine room at the front face of the machine room. The base cover 40 may be disposed to cover all of the plurality of machine rooms 30 arranged in the horizontal direction. Therefore, a gap between one machine room and another machine room is not visible to the outside by the base cover 40.

In addition, in order to cover a gap in the horizontal direction between one cooling unit 20 and another cooling unit 20, a screen or a decor 50 may be disposed.

The decor 50 may be located on a rear face of the shared refrigerator 1. Specifically, the decor that is vertically long covers the gap in the horizontal direction between one cooling unit and the other cooling unit. Accordingly, the integrity of the appearance may be secured at the front face of the shared refrigerator 1.

In one example, it may be necessary for the aforementioned sub-elements (the cooling units, the refrigerator modules, and the machine rooms) to maintain a coupling force between the sub-elements by an external force as well as connection by simple surface contact. For this purpose, a separate fastening portion may be disposed.

However, it may be necessary to avoid increasing a gap between the sub-elements resulted from the fastening by the fastening portion. In addition, integrity of the appearance due to the fastening portion also needs to be preserved. An example of the fastening portion for solving this will be described with reference to FIG. 4.

Figure 4:
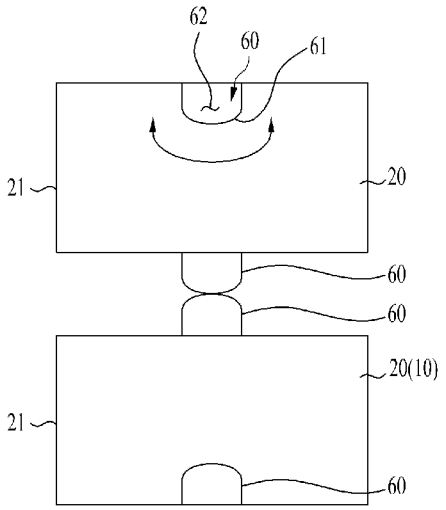
FIG. 4 briefly shows a coupling structure of one cooling unit and another cooling unit that may be applied to one embodiment of the present disclosure.

FIG. 4 schematically shows a coupled state of cooling units, refrigerator modules, and machine rooms, which are sub-elements.

Each of the refrigerator module 10, the cooling unit 20, and the machine room 30 may have a cabinet forming an outer appearance thereof. FIG. 4 shows coupling between the cabinet 21 of one cooling unit 20 and the cabinet 21 of another cooling unit 20 as an example.

A coupling portion 60 for coupling with other sub-elements may be formed on at least one of a top face, a bottom face, and side faces of the cabinet 21. The coupling portion may be pivotable with respect to the cabinet 21. Because of such pivoting, the coupling portion may be located inside the cabinet 21 or outside the cabinet.

The coupling portion 60 of one cooling unit 20 may be mated with the coupling portion 60 of an adjacent cooling unit 20. To this end, the coupling portion 60 of the one cooling unit may be a protrusion 61 that may protrude out of the cabinet and the coupling portion 60 of the adjacent cooling unit may be an accommodating portion 62 that may accommodate therein the protrusion 61 of the one cooling unit. As the coupling portion 60 is formed in a cup shape, the protrusion portion or the accommodating portion may be formed by pivoting.

When the two cooling units are coupled to each other, the coupling portion 60 of one cooling unit may be positioned such that the protrusion 61 thereof faces the interior of the cabinet 21. In this regard, the entire coupling portion 60 may be located inside the cabinet. The coupling portion 60 of the other cooling unit may be positioned such that the protrusion 61 thereof protrudes outwardly of the cabinet 21. The protrusion 61 protruding out of the cabinet may be inserted into the accommodating portion 62 of the one cooling unit.

Accordingly, the gap between one cooling unit and the other cooling unit may be minimized through the mating of the coupling portion 60 of one cooling unit and the coupling portion 60 of the other cooling unit. In addition, because the coupling portion 60 is not substantially exposed to the outside, the aesthetic design may be preserved.

In one example, not only the physical coupling between the sub-elements through the coupling portion 60 is possible, but also electrical connection or control connection between the cooling units may be possible. This means that the plurality of cooling units may be controlled through one machine room.

In addition, the coupling portions 60 may be disposed not only for the vertical coupling of the sub-elements, but also for the horizontal coupling of the sub-elements. When the two refrigerator modules 10 are closely positioned in the horizontal direction, the coupling via the coupling portions 60 may be possible.

In this regard, the coupling via the coupling portions 60 between all adjacent sub-elements may not be required. This is because one refrigerator module 10 and another refrigerator module 10 may be individually controlled through the respective machine rooms. Accordingly, only the coupling via the coupling portions 60 between one machine room and another machine room and coupling via the coupling portions 60 between the uppermost cooling unit and another cooling unit may be required. In this case, one refrigerator module 10 may serve as a main controller, and other refrigerator modules 10 may serve as sub-controllers. The main controller may control the sub-controllers and a display, and the main controller may also communicate with the user or the provider.

As described above, the shared refrigerator 1 according to the present embodiment includes the individual cooling unit 20. Because frost is formed inside the storage chamber of the cooling unit, defrosting is required. As will be described later, in a case of direct cooling, there is a greater risk of frost forming on a wall face or a radiational cooling plate of the storage chamber. However, it is not easy to implement a separate defrosting system for each individual cooling unit 20. This is because, when the defrosting system is implemented individually, a capacity of the storage chamber in the cooling unit is inevitably reduced.

Figure 5:
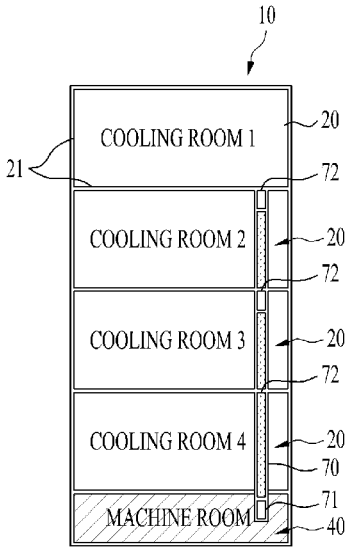
FIG. 5 briefly shows an example of a defrosting system of a refrigerator module that may be applied to one embodiment of the present disclosure.

FIG. 5 shows a concept of applying a defrosting system in the refrigerator module 10 of the shared refrigerator according to one embodiment of the present disclosure. In particular, a simplified view of the rear face of the refrigerator module is shown.

An opening 72 may be defined in a bottom face of the storage chamber such that defrosting water is discharged out of the storage chamber. The opening 72 may be connected to a defrosting water line 70, and the defrosting water line 70 may extend through the bottom face of the cabinet 21 to extend through a top face of the cabinet 21 of a lower cooling unit 20.

That is, the uppermost cooling unit 20 may have only one opening 72 defined at the bottom face of the cabinet 21 thereof. Each of the remaining cooling units 20 may have the openings 72 respectively defined in the top face and the bottom face of the cabinet 21 thereof. The defrosting water generated in each storage chamber may be introduced into the machine room 40 through the defrosting water line 70. The machine room 40 may have a defrosting water container 71 for storing the defrosting water therein.

As shown, the defrosting water line 70 is preferably disposed biased to a rear face of the refrigerator module 10. This is to prevent reduction in a storage space. In addition, it is preferable that the defrosting water line is disposed biased to the left or right of the refrigerator module. This is to use the storage space efficiently.

In one example, the defrosting is preferably performed in an entirety of one refrigerator module 10. That is, the start and end of the defrosting may be performed identically for one refrigerator module.

First, each storage chamber may be equipped with a temperature sensor for controlling a temperature of the storage chamber. Because this is a very basic component in the refrigerator, separate illustration and description thereof will be omitted.

A defrosting time point may be determined by considering a temperature sensed via the temperature sensor, an operating time of a compressor, an opening time of the door, and the like. In addition, the defrosting may be carried out at the same time for the refrigerator modules 10. When the temperature sensors of all of the storage chambers sense a temperature equal to or higher than a certain temperature, the defrosting may be terminated.

The defrosting may be performed as opposed to cooling. That is, the defrosting may be performed by increasing the temperature of the storage chamber by stopping the operation of the compressor. When a fan is disposed in the storage chamber, natural defrosting may be possible by driving only the fan. In addition, forced defrosting may be performed through a separate defrosting heater. The defrosting heater may be coupled to the radiational cooling plate to perform the defrosting.

Because the defrosting via the fan driving or the defrosting heater is a common feature in the refrigerator, illustration and description thereof will be omitted. However, in the present embodiment, each cooling unit 20 in the refrigerator module 10 having the storage chamber that is individually opened and closed by the door may have the built-in defrosting water line 70 or the opening 72 defined therein for the connection with the defrosting water line 70.

In one example, the defrosting water line may be equipped with a defrosting water container and a trap. The defrosting water container and the trap may have a structure that is normally closed and is opened when a weight exceeds a certain weight. That is, the defrosting water generated in each storage chamber may be concentrated on the bottom face of the storage chamber, and the defrosting water container and the trap may be normally closed, but may be opened when the weight of the defrosting water exceeds the certain weight. Because shapes and structures of the defrosting water container and the trap are generally known, illustration and description thereof will be omitted.

Therefore, according to the present embodiment, simultaneous defrosting may be possible for the refrigerator modules. To this end, the defrosting system may be applied as described above.

In order to perform the defrosting more effectively, a defrosting water spout, a heater, or the like may be added. In addition, it is possible to solve problems that may occur due to the simultaneous defrosting.

Figure 6:
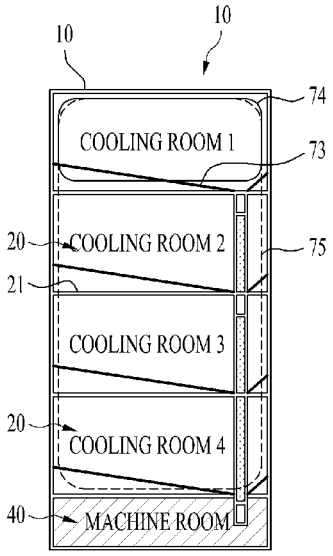
FIG. 6 briefly shows an example of another defrosting system of a refrigerator module that may be applied to one embodiment of the present disclosure.

As shown in FIG. 6, to the basic defrosting system shown in FIG. 5, the defrosting water spout, the heater, or the like may be added.

Specifically, an inclined defrosting water spout 73 may be located on the bottom face of the storage chamber. The defrosting water spout 73 may be installed on a bottom face of a rear wall of the storage chamber. The lowermost portion of the defrosting water spout 73 may be connected to the opening 72. Accordingly, the defrosting water may be discharged to the outside through the defrosting water spout 73, the opening 72, and the defrosting water line 70.

In one example, the defrosting water may freeze. Although not shown, an anti-freezing heater may be mounted near the defrosting water spout 73.

For the defrosting, the defrosting heater 73 may be disposed. The defrosting heater 73 may be mounted inside the rear wall of the storage chamber. That is, the defrosting heater may be disposed between the rear wall of the storage chamber and the cabinet. The defrosting heater 73 may be disposed individually for each cooling unit. A defrosting sensor for determining the start and the end of the defrosting may be disposed near the defrosting heater 73.

When defrosting the plurality of storage chambers at the same time, a temperature of a storage chamber that does not require the defrosting may be unnecessarily raised. Therefore, it is possible to perform the defrosting only for a storage chamber that requires the defrosting through the defrosting sensor.

In one example, the heater for the defrosting may not be disposed individually for each cooling unit, but may be disposed throughout the refrigerator module. This may be referred to as a module defrosting heater 75. When the module defrosting heater 75 is driven, the defrosting for the entire refrigerator module may be performed.

When defrosting of a specific storage chamber is required, the fan inside the specific storage chamber may be driven primarily. In this case, only the necessary storage chamber may be defrosted naturally. In one example, when the fan is not installed inside the storage chamber, the primary defrosting may be omitted.

When it is determined that more defrosting is required based on the temperature, the defrosting heater 74 may be operated to perform the defrosting secondarily. In one example, when the defrosting heater 74 is not installed, the secondary defrosting may be omitted.

A temperature rise slope of the defrosting sensor may be determined, so that, when additional defrosting is required, the module defrosting heater 75 may be driven tertiarily to perform overall defrosting. In another example, when the module defrosting heater 75 is not installed, the tertiary defrosting may be omitted.

Therefore, because the secondary or tertiary defrosting may be performed, it is possible to more effectively perform the defrosting of the plurality of storage chambers.

The shared refrigerator according to the present embodiment may be referred to as a refrigerator in which the storage chambers are respectively used by separate users. Therefore, it is preferable that the storage chambers do not share cold air or odors. In other words, it may be necessary to apply separate cooling systems for the respective storage chambers. However, in this case, a plurality of flow path structures and a plurality of machine rooms need to be installed. Therefore, modularization is not easy.

In order to solve such problem, the shared refrigerator according to one embodiment of the present disclosure may perform individual cooling for each storage chamber by applying a cold air circulating module or a cold air circulating flow path.

Hereinafter, a shared refrigerator and a refrigerator module to which the cold air circulation module is applied will be described in detail with reference to FIGS. 7 to 9.

Figure 7:
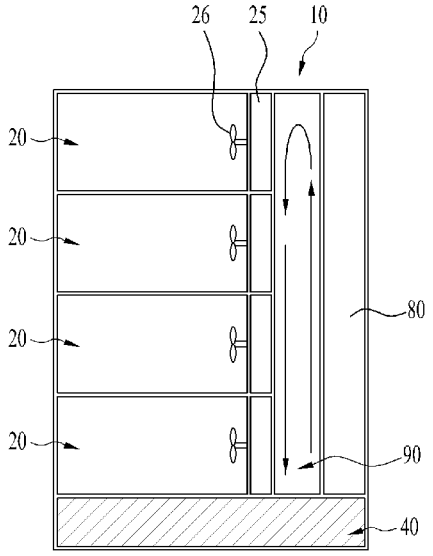
FIG. 7 briefly shows a cross-section of a refrigerator module that may be applied to one embodiment of the present disclosure.
Figure 8:
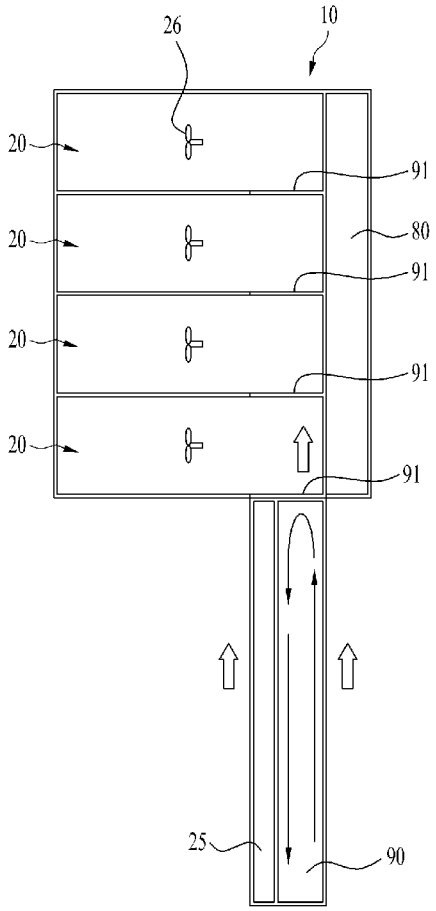
FIG. 8 briefly shows a mounting structure of a cooling flow path in a refrigerator module shown in FIG. 7.

FIG. 7 briefly shows a side face of a shared refrigerator to which a cold air circulation module is applied, and FIG. 8 shows a state in which a cold air circulation module is separated from a shared refrigerator.

As shown, the cooling units and the storage chambers inside the respective cooling units are partitioned from each other. That is, the cooling units and the storage chambers inside the cooling units do not share the cold air.

A radiational cooling plate 25 may be disposed on the rear wall of each cooling unit 20. As a temperature of the radiational cooling plate decreases, an interior temperature of the storage chamber may decrease by radiation cooling. The radiational cooling plate itself may be the rear wall of the storage chamber. The radiational cooling plate may be referred to as a portion of the storage chamber.

The cold air circulating module may be mounted in the rear of the radiational cooling plates 25 of the cooling units 20. This may be referred to as a cold air circulating flow path 90. After the cold air generated in the machine room 40 flows to an upper portion of the cold air circulating flow path 90, the cold air may descend and be introduced into the machine room 40. The descending cold air exchanges heat with the radiational cooling plate 25 to cool the radiational cooling plate.

A rear face heat insulating portion 80 may be disposed in the rear of the radiational cooling plate 25. Therefore, the circulated cold air may cool the radiational cooling plate 25 very efficiently.

The cold air circulating in the cold air circulating flow path 90 does not flow into the storage chamber. Therefore, independent cooling for each storage chamber is possible, and the cold air and the odor of the respective storage chambers do not mix with each other.

A plurality of radiational cooling plates 25 may be installed in the storage chambers. In addition, a plurality of heat transfer fins may be formed on the radiational cooling plate, and the heat transfer fin may have various shapes such as a square, a triangular, or a circular shape.

The radiational cooling plate may be installed separately from or integrally with the cold air circulating flow path 90. FIG. 8 shows a structure in which the radiational cooling plate 25 and the cold air circulating flow path 90 are integrally mounted to the refrigerator module 10.

As an example, an insertion hole 91 into which the radiational cooling plate and the cold air circulating flow path are inserted may be defined at a rear portion of a cabinet of a cooling unit 20.

Basically, the insertion hole 91 may be defined in each of the bottom face and the top face of the cabinet of each of the cooling units. However, the insertion hole may be defined only in the bottom face of the cabinet of the uppermost cooling unit. In another example, the uppermost cooling unit may be the same as the other cooling units. In this case, a separate stopper or cover for opening and closing the insertion hole defined in the top face of the cooling unit may be mounted. Accordingly, manufacturing is facilitated by manufacturing the cooling units to have basically the same structure.

Each storage chamber may have a fan 26 to increase a cooling efficiency. However, when an internal space of the storage chamber is relatively small, the fan 26 may be omitted.

In one example, a capacity of the storage chamber in the cooling unit 20 of the refrigerator module 10 is inevitably reduced due to the radiational cooling plate and the cold air circulating flow path. Accordingly, a single cooling unit may be disposed independently of the refrigerator module 10. Such a single cooling unit may use a cooling scheme different from that of the cooling unit in the refrigerator module 10.

Figure 9:
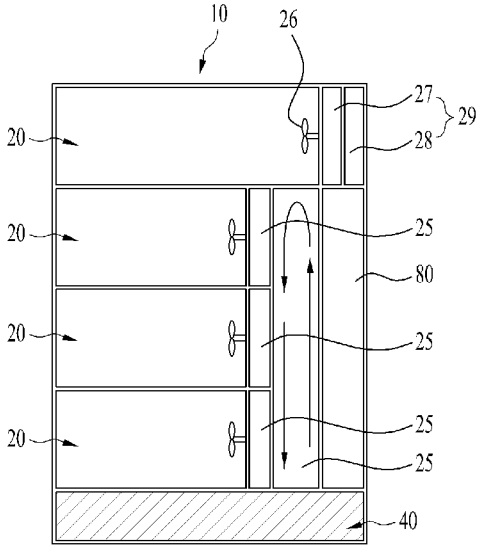
FIG. 9 schematically shows a coupled state of a refrigerator module and a cooling unit that may be applied to one embodiment of the present disclosure.

As an example, the uppermost cooling unit shown in FIG. 9 may be cooled via a thermoelectric module 29. A small refrigerator using the thermoelectric module 29 is disclosed in Korean Patent (Application No. 10-2017-0035608) applied by the present applicant.

That is, the thermoelectric module 29 may be applied to a cooling unit having a premium cooling compartment with low noise.

The thermoelectric module 29 forms a rear wall of a refrigerating compartment. Specifically, the thermoelectric module 29 may include a thermoelectric element, and a cooling sink 27 may be disposed in front of the thermoelectric element and a heat sink 28 may be disposed in the rear of the thermoelectric element. That is, the thermoelectric element is divided into a low temperature portion and a high temperature portion based on its own characteristics. The cooling may be performed by a temperature difference between the low temperature portion and the high temperature portion.

That is, the cooling sink 27 formed in the low temperature portion forms the rear wall of the storage chamber to cool the storage chamber. In addition, the heat sink 28 formed in the high temperature portion may be exposed to the outside to dissipate the heat through natural convection.

In this regard, the cooling scheme to which the thermoelectric module 29 is applied is independently applied to the cooling unit. Therefore, there is no mixing of cold air between the storage chamber of the cooling unit and another storage chamber of another cooling unit. Therefore, one cooling unit may be applied as the premium cooling compartment, which may be a cooling unit that is easily added to an existing refrigerator module.

In another example, it may be possible to construct said one refrigerator module 10 with cooling units to which such thermoelectric module is applied.

In order to solve various problems such as the aforementioned cold air mixing problem, the shared refrigerator according to one embodiment of the present disclosure may perform the individual cooling for each storage chamber by applying a refrigerant pipe module or a refrigerant pipe flow path.

Hereinafter, a shared refrigerator and a refrigerator module to which the refrigerant pipe module is applied will be described in detail with reference to FIGS. 10 to 13.

Figure 10:
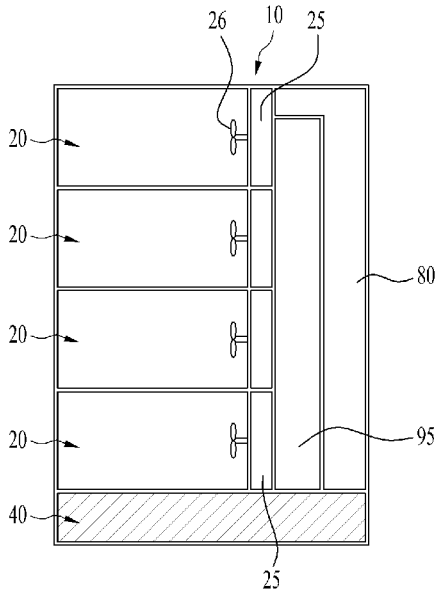
FIG. 10 briefly shows another cross-section of a refrigerator module that may be applied to one embodiment of the present disclosure.

FIG. 10 briefly shows a side face of a shared refrigerator to which a cold air circulating module is applied.

As shown, the cooling units and the storage chambers inside the respective cooling units are partitioned from each other. That is, the cooling units and the storage chambers inside the cooling units do not share the cold air.

The radiational cooling plate 25 may be disposed on the rear wall of each cooling unit 20. As the temperature of the radiational cooling plate decreases, the interior temperature of the storage chamber may decrease by the radiation cooling. The radiational cooling plate itself may be the rear wall of the storage chamber. The radiational cooling plate may be referred to as the portion of the storage chamber.

The refrigerant pipe module may be mounted in the rear of the radiational cooling plates 25 of the cooling units 20. This may be referred to as a refrigerant pipe flow path 95. After a refrigerant compressed in the machine room 40 cools the radiational cooling plate while flowing through a refrigerant pipe, the refrigerant may be introduced into the machine room 40.

The rear face heat insulating portion 80 may be disposed in the rear of the radiational cooling plate 25. Therefore, the circulated refrigerant may cool the radiational cooling plate 25 very efficiently.

The refrigerant circulated in the refrigerant pipe flow path 95 directly cools the radiational cooling plate in contact with the radiational cooling plate. Therefore, the independent cooling for each storage chamber is possible, and the cold air and the odor of the respective storage chambers do not mix with each other.

The plurality of radiational cooling plates 25 may be installed in the storage chambers. In addition, the plurality of heat transfer fins may be formed on the radiational cooling plate, and the heat transfer fin may have various shapes such as the square, the triangular, or the circular shape.

The radiational cooling plate may be installed separately from or integrally with the refrigerant pipe flow path 95. As an example, the refrigerant pipe may be integrally formed on the radiational cooling plate. For example, the radiational cooling plate and the refrigerant pipe may be integrally formed by a roll bond method.

Such example in which the radiational cooling plate and the refrigerant pipe are integrally formed may be similar to an evaporator forming a freezer compartment of the small refrigerator. This is an example in which the refrigerant pipe is integrally formed with a metal plate. In this case, as shown in FIG. 8, the radiational cooling plate and the refrigerant pipe flow path may be integrally mounted in the refrigerator module 10. That is, the insertion hole 91 into which the radiational cooling plate and the refrigerant pipe flow path are inserted may be defined at the rear portion of a cabinet of a cooling unit 20.

In one example, the single cooling unit to which the thermoelectric module 29 is applied as described above may also be located on top of the refrigerator module 10 in the present embodiment.

Figure 11:
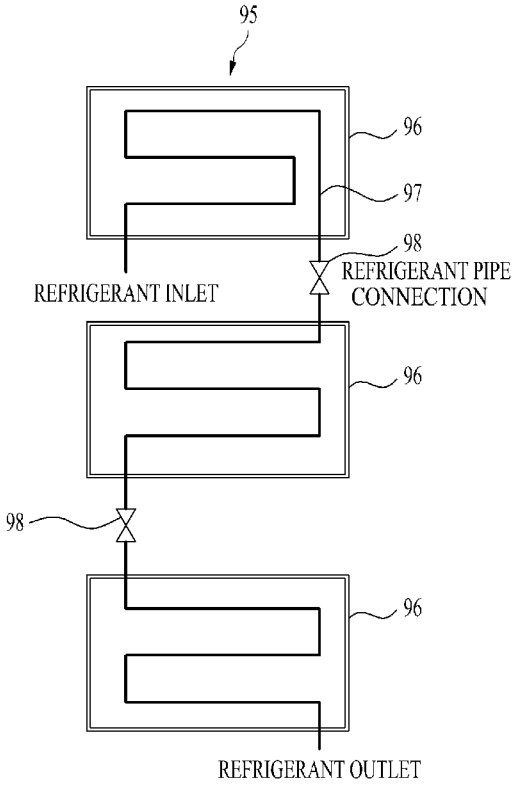
FIGS. 11 to 13 schematically show structures of a radiational cooling plate that may be applied to a refrigerator module shown in FIG. 10.
Figure 12:
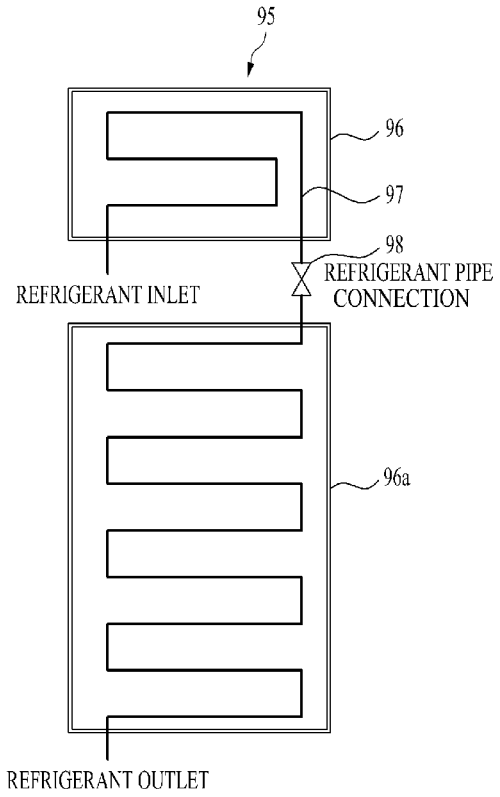
Figure 13:
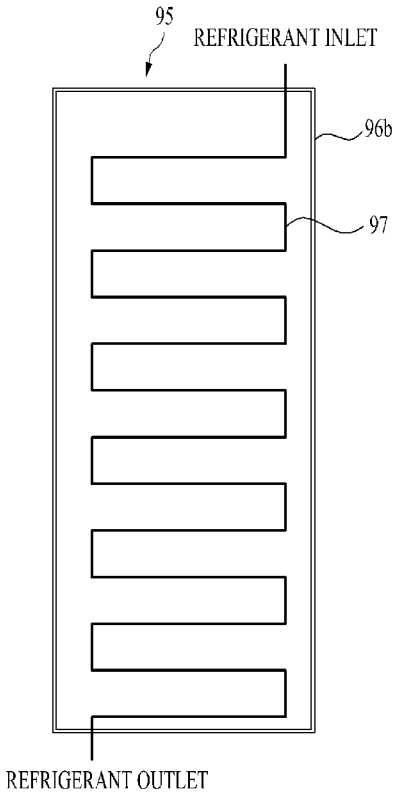

FIGS. 11 to 13 show plates 96 and refrigerant pipes 97 integrally formed on the plates 96.

As shown, the plate 96 may be formed independently for each cooling unit. Alternatively, some plates may be formed integrally and the remaining plates may be formed independently, or the entire plates may be formed integrally. That is, as the number of plates 96 for respectively covering the storage chambers of the same number increases, the number of connecting portions 98 for connecting the refrigerant pipes between two plates inevitably increases. FIG. 11 shows a case in which there are two refrigerant pipe connecting portions, FIG. 12 shows a case in which there is one refrigerant pipe connecting portion, and FIG. 13 shows a case in which there is no refrigerant pipe connecting portion. One inlet through which the refrigerant flows into the plate 96 and one outlet through which the refrigerant is discharged should be formed in all of the cases in FIGS. 11 to 13. The refrigerant pipe for connecting the inlet and the outlet to each other may be embedded in the rear face heat insulating portion 80 independently of the plate 96.

In this regard, the plate 96 may be a component that is in close contact with the radiational cooling plate 25 to cool the radiational cooling plate. Or, the plate 96 may be the radiational cooling plate itself.

The connecting portion of the refrigerant pipes, the inlet, the outlet, and the refrigerant pipe connected to the inlet and the outlet described above may all be embedded in the rear face heat insulating portion 80.

As an example, all of such components may be formed into a single cartridge and inserted and mounted in the refrigerator module. Thereafter, the rear face heat insulating portion may be formed through foaming.

Therefore, module manufacturing is very simple.

The invention claimed is:

1. A refrigerator comprising:

a plurality of refrigerator modules, wherein a refrigerator module includes:

a cabinet forming an appearance of the refrigerator module and having a plurality of storage chambers therein;

a door disposed for each storage chamber;

a radiational cooling plate forming a rear wall of each storage chamber, wherein the radiational cooling plate is disposed to block air communication between an interior of the storage chamber and an interior of another storage chamber, wherein the radiational cooling plate cools the interior of the storage chamber through radiational cooling;

a refrigerant pipe flow path disposed at a rear of the radiational cooling plate to exchange heat with the radiational cooling plate; and a machine room for discharging a refrigerant to the refrigerant pipe flow path and sucking the refrigerant that has exchanged heat with the radiational cooling plate, wherein an opening is defined in each of a top face and a bottom face of the cabinet such that a defrosting water line extends through the cabinet.

2. The refrigerator of claim 1, wherein the plurality of storage chambers are arranged in a vertical direction, and the machine room is disposed beneath the refrigerator module.

3. The refrigerator of claim 2, wherein the plurality of refrigerator modules are arranged to be adjacent to each other in a horizontal direction.

4. The refrigerator of claim 3, wherein each refrigerator module includes a corresponding machine room, and the refrigerator includes a base cover for covering the plurality of machine rooms from a front of the refrigerator.

5. The refrigerator of claim 3, further comprising a decor for covering a gap in the horizontal direction between the refrigerator modules from a rear of the cabinet.

6. The refrigerator of claim 1, wherein the door has a user interface for authenticating a user.

7. The refrigerator of claim 6, wherein the user interface includes a near-field communication (NFC) communication module.

8. The refrigerator of claim 1, wherein the cabinet is integrally formed to integrally accommodate the plurality of storage chambers therein.

9. The refrigerator of claim 1, wherein the cabinet includes a plurality of cabinets separately formed to respectively accommodate the plurality of storage chambers therein and the plurality of cabinets are coupled to each other.

10. The refrigerator of claim 9, wherein each cabinet includes a coupling portion movable between an interior of the cabinet and an exterior of the cabinet by pivoting, wherein adjacent cabinets are coupled to each other by mating of coupling portions of respective adjacent cabinets.

11. The refrigerator of claim 10, wherein a coupling portion is configured to pivot between a protrusion portion and an accommodating portion, wherein a protrusion of one coupling portion is inserted into an accommodating portion of another coupling portion between adjacent cabinets.

12. The refrigerator of claim 1, wherein the radiational cooling plate is disposed on the rear wall of each storage chamber, wherein a radiational cooling plate of one storage chamber is separately formed from a radiational cooling plate of another storage chamber.

13. The refrigerator of claim 12, wherein the refrigerant pipe flow path is disposed to be adjacent to each of the radiational cooling plates.

14. The refrigerator of claim 13, wherein the radiational cooling plates and the refrigerant pipe flow path are integrally formed.

15. The refrigerator of claim 14, wherein an insertion hole is defined in each of a top face and a bottom face of the cabinet such that the refrigerant pipe flow path is inserted into and extends through the cabinet.

16. The refrigerator of claim 1, wherein the radiational cooling plates are integrally formed to be a single radiational cooling plate, such that the single radiational cooling plate forms the rear walls of the plurality of storage chambers.

17. The refrigerator of claim 16, wherein the single radiational cooling plate and the refrigerant pipe flow path are integrally formed.

18. The refrigerator of claim 17, wherein an insertion hole is defined in each of a top face and a bottom face of the cabinet such that the single radiational cooling plate and the refrigerant pipe flow path are inserted into and extend through the cabinet.

19. The refrigerator of claim 1, wherein the defrosting water line vertically extends through the plurality of storage chambers and extends to a bottom face of an uppermost storage chamber.

20. A refrigerator comprising:

a plurality of refrigerator modules, wherein a refrigerator module includes:

a cabinet forming an appearance of the refrigerator module and having a plurality of storage chambers therein;

a door disposed for each storage chamber;

a radiational cooling plate forming a rear wall of each storage chamber, wherein the radiational cooling plate is disposed to block air communication between an interior of the storage chamber and an interior of another storage chamber, wherein the radiational cooling plate cools the interior of the storage chamber through radiational cooling;

a refrigerant pipe flow path disposed at a rear of the radiational cooling plate to exchange heat with the radiational cooling plate; and a machine room for discharging a refrigerant to the refrigerant pipe flow path and sucking the refrigerant that has exchanged heat with the radiational cooling plate, wherein the cabinet includes a plurality of cabinets separately formed to respectively accommodate the plurality of storage chambers therein and the plurality of cabinets are coupled to each other, and wherein each cabinet includes a coupling portion movable between an interior of the cabinet and an exterior of the cabinet by pivoting, wherein adjacent cabinets are coupled to each other by mating of coupling portions of respective adjacent cabinets.

* * * * *